United States Patent [19]
de Munnik

[11] 3,938,689
[45] Feb. 17, 1976

[54] PROCESSING TANK

[76] Inventor: Nicholas Marie de Munnik, 450 Walmer Road, Apt. 409, Toronto, Ontario, Canada

[22] Filed: July 8, 1971

[21] Appl. No.: 486,616

[52] U.S. Cl. ..... 220/71; 220/1 B; 220/9 A; 220/10; 220/15
[51] Int. Cl.[2] ..... B65D 25/18; B65D 7/22
[58] Field of Search ..... 220/1 B, 5 A, 9 A, 9 LG, 220/71, 72, 10, 3, 15

[56] References Cited

UNITED STATES PATENTS

| | | | |
|---|---|---|---|
| 1,983,355 | 12/1934 | Escher | 220/1 B |
| 2,221,470 | 11/1940 | Brown | 220/3 |
| 2,313,997 | 3/1943 | Jackson | 220/1 B |
| 3,047,190 | 7/1962 | Bayer | 220/71 |
| 3,310,106 | 3/1967 | Leseelleur et al. | 220/71 |
| 3,688,940 | 9/1972 | Knight et al. | 220/71 |

*Primary Examiner*—Donald F. Norton
*Assistant Examiner*—Joseph M. May

[57] ABSTRACT

A tank of relatively thin wall construction, and which is provided with a plurality of exterior reinforcing vertical and horizontal rib members, and in which the tank itself is of a generally rectangular shape in cross section, having a flat bottom, an upwardly arched roof, and inwardly arched side walls, the ribs extending completely around the tank at spaced intervals along its length, and being arranged in such a manner that the hydrostatic pressures developed in the tank will be resisted by bending stresses in the vertical ribs, and tensile stresses in the horizontal ribs, and in which provision is made for lengthwise expansion and contraction of the tank.

12 Claims, 4 Drawing Figures

PROCESSING TANK

The invention relates to a large volume processing tank of thin wall construction designed to withstand substantial hydrostatic pressures.

BACKGROUND OF THE INVENTION

Processing tanks of large volume, typically containing anywhere from 30,000 to 100,000 gallons of liquid are required in many different fields. Such tanks are of special interest in connection with the brewing of beer, and the distilling of liquor, but are also of interest in many other fields. In the particular case of the beer and liquor industry however, such tanks must be manufactured of stainless steel, and accordingly require to be manufactured of relatively thin gauge stainless steel to keep the expense within a reasonable limitation. Clearly, such thin walled material will be unable to withstand the hydrostatic pressures imposed by such large volumes of liquid. Accordingly, it is the common practice to provide such thin walled tanks in various shapes, with reinforcing ribs around the exterior. In addition, tanks of this kind are required to be cooled so as to control the processing temperature. Cooling jackets are therefore mounted on the exterior of the tank for this purpose.

Tanks of this kind, are usually of considerable length, and must usually be cleaned and sterilized between each usage. Cleaning and sterilization are commonly carried out with liberated steam. As a result, the tanks are subjected to substantial elevated temperatures, and consequently they are liable to extend and contract to a relatively substantial extent during use. For example, a stainless steel tank fifty feet in length might extend and contract by a distance of about one half to three quarters of an inch during such a cleaning operation, and the stresses developed by such expansion and contraction must in some way be relieved in order to prevent damage to the structure.

Clearly, it would be possible to construct a tank having a cylindrical cross section which would withstand all of the hydrostatic pressures developed, and would perform in a satisfactory manner. However, the requirements of the beer and liquor industry call for processing tanks having a flat bottom, and tanks of this shape are required in many other fields. Flat bottomed tanks of this capacity will therefore require very substantial reinforcement in order to withstand the stresses imposed upon them, and many such systems of reinforcement have been proposed. However, they have generally speaking, been unsatisfactory. When filled with water, substantial stresses were developed in the side walls, tending to bend them outwardly and the roof was then liable to cave in. Reinforcing against such stresses, particularly in the roof, is difficult since the roof, when stressed will tend to cave in between the reinforcing ribs.

In almost all such systems the stresses imposed upon the reinforcement around the tank were bending stresses, and as is well known, any element can more efficiently resist axial tensile loads than loads causing bending.

BRIEF SUMMARY OF THE INVENTION

The invention therefore seeks to provide a processing tank of the general type described in which the tank itself is of relatively thin wall construction, and which is provided with a plurality of exterior reinforcing rib members, and in which the tank itself is of a generally rectangular shape in cross section, having a flat bottom, an upwardly arched roof, and inwardly arched side walls, the ribs extending completely around the tank at spaced intervals along its length, and being arranged in such a manner that the hydrostatic pressures developed in the tank will be resisted by loading the vertical ribs in bending and the horizontal top and bottom ribs in axial tension. The top rib is curved or arched to follow the line of the top wall of the tank, but is arranged to function as a tie rod by ensuring that the line of action of the axial forces on such top rib does not intersect the inside radius of the rib. In addition provision is made for lengthwise expansion and contraction of the tank.

More particularly, it is an objective of the invention to provide a tank having the foregoing advantages which incorporates cooling jacket means along at least a part of either side of the tank.

More particularly, it is an objective of the invention to provide a tank with the foregoing advantages incorporating cooling jacket means and reinforcing means around the cooling jacket means along the length of the tank, said reinforcing means being discontinuous whereby to permit expansion and contraction of the tank.

More particularly, it is an objective of the invention to provide a tank having the foregoing advantages in which the weight of the tank is supported on a plurality of transverse beam members arranged width-wise of the tank. Without any longitudinal beam members being tied thereto, thereby permitting the tank to expand and contract lengthwise during use.

The foregoing and other objectives of the invention will become apparent from the following description of a preferred embodiment which is given here with reference to the following drawings, by way of example only.

DESCRIPTION OF A PREFERRED EMBODIMENT

Figure 1:
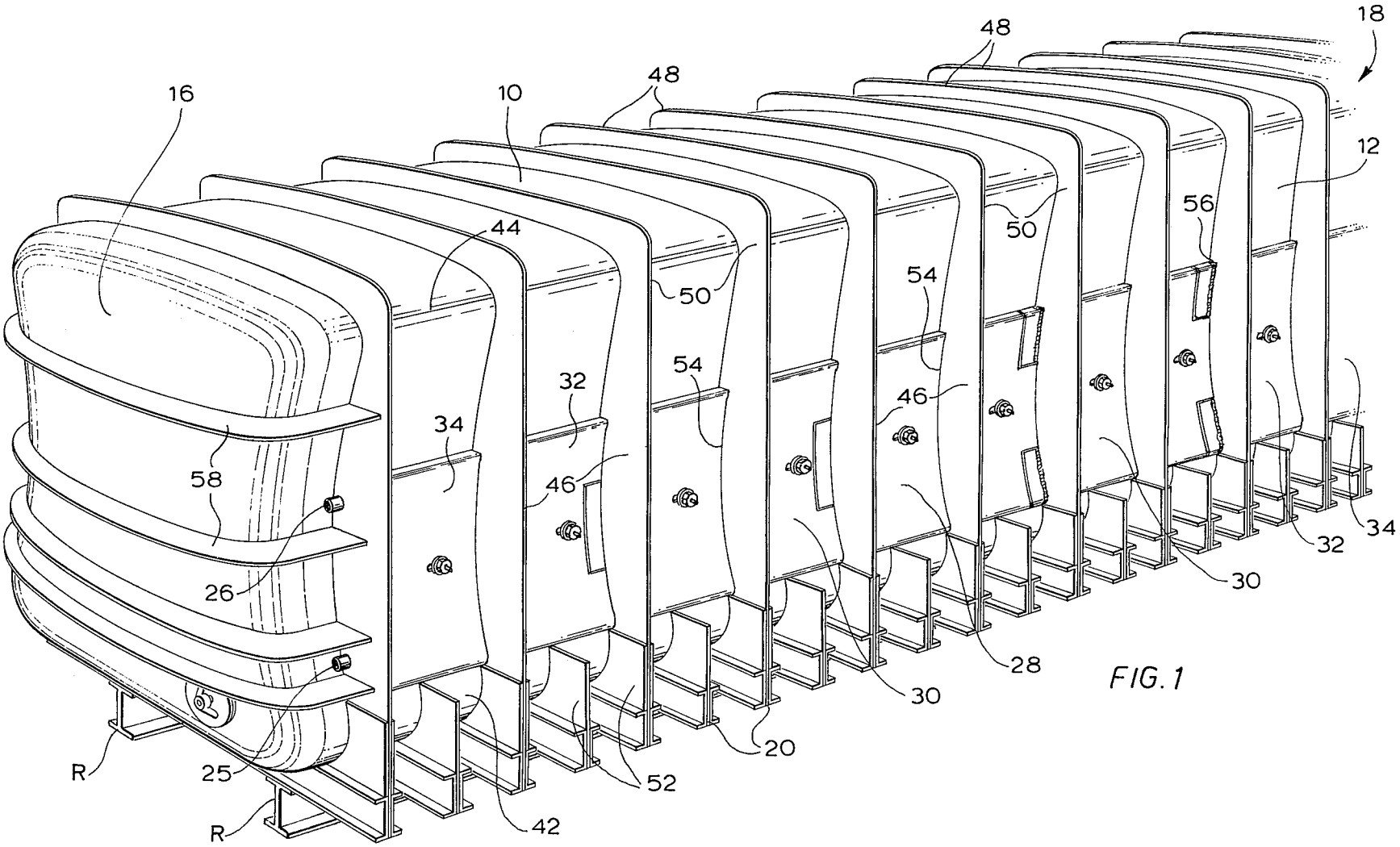
FIG. 1 is a perspective illustration of a tank according to the invention partly cut away.
Figure 2:
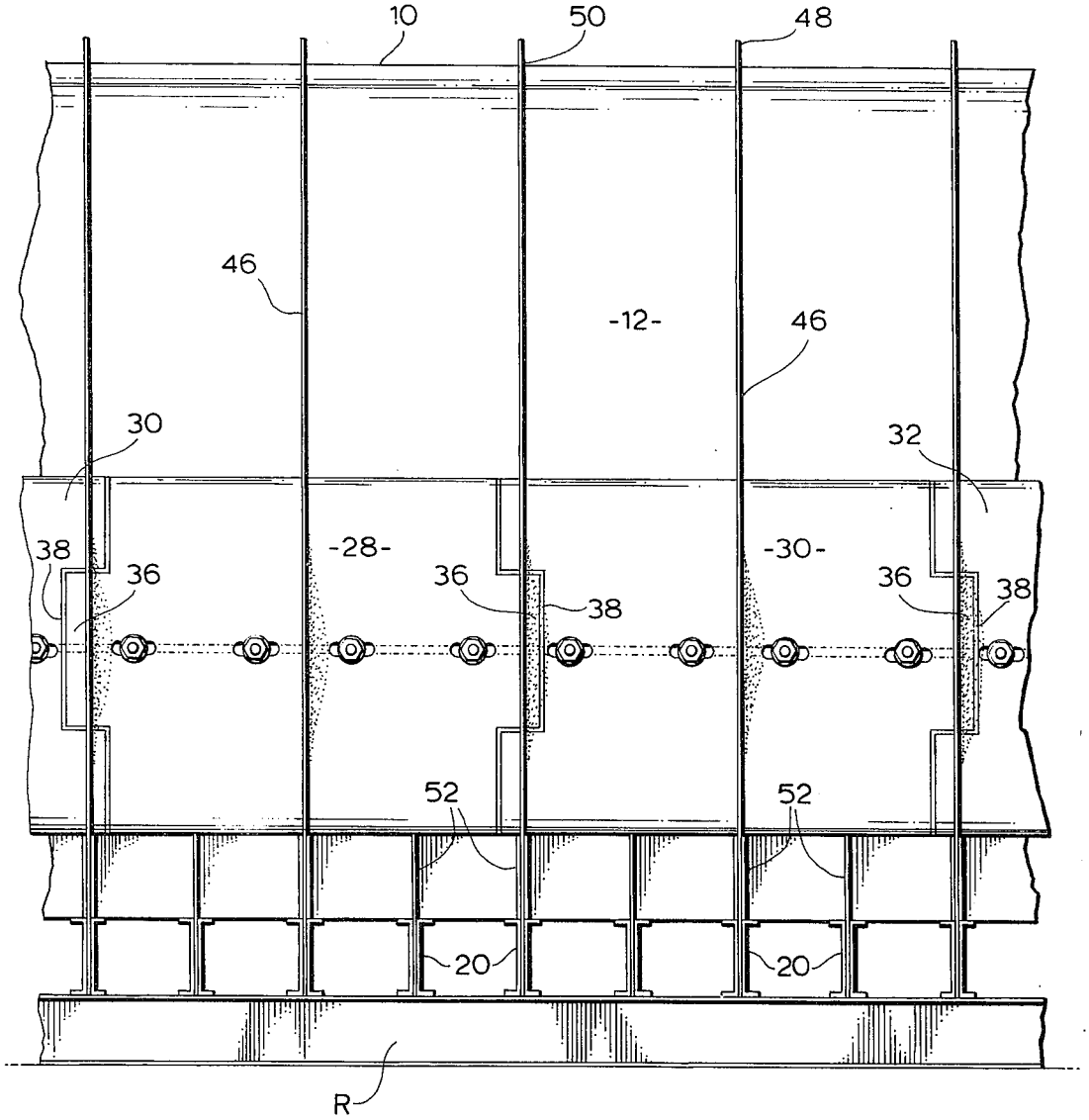
FIG. 2 is a side elevational view of the tank in FIG. 1 partially cut away.
Figure 3:
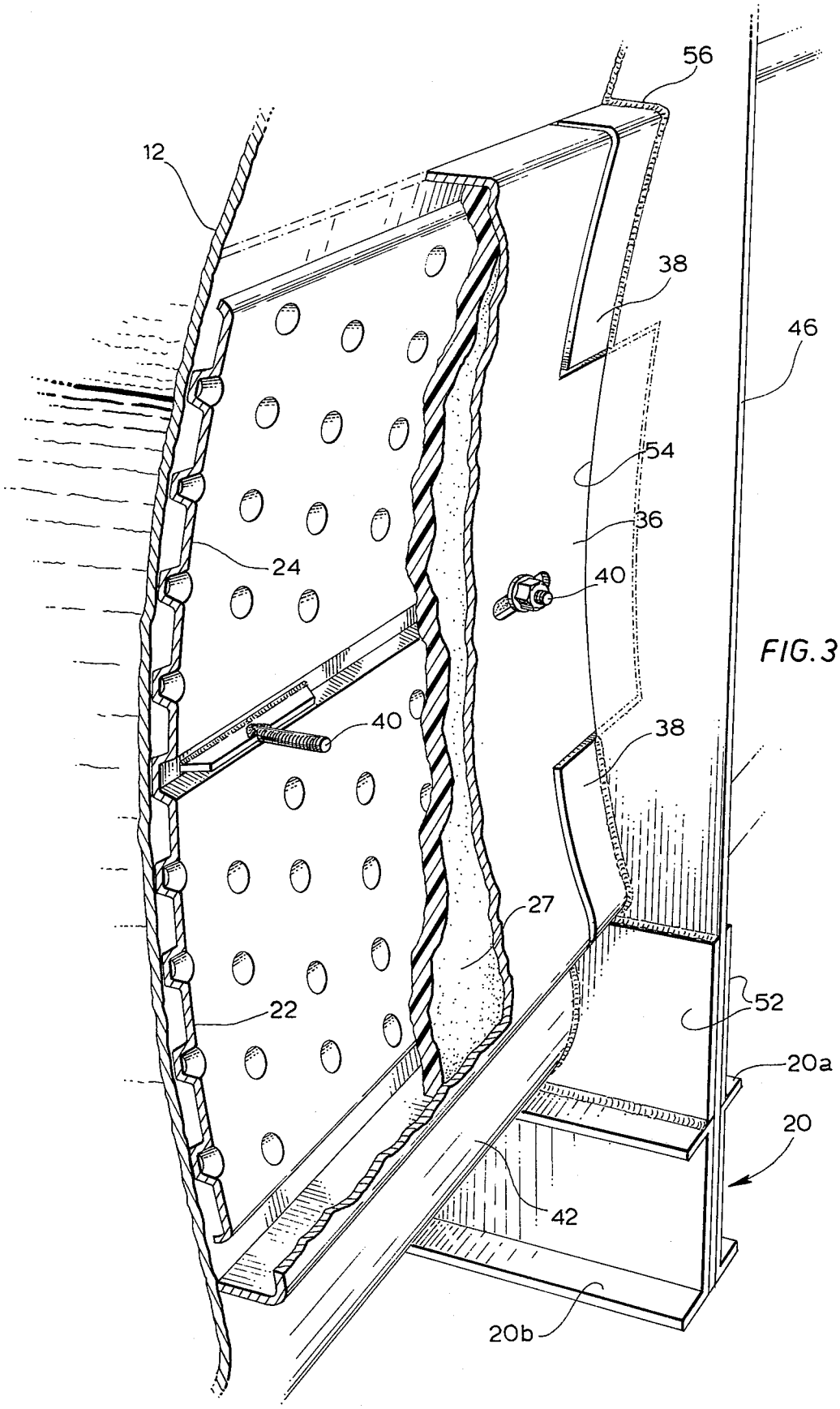
FIG. 3 is a perspective illustration of a portion of a side wall cut away to show the cooling jacket construction, and, FIG. 4 is a section along the line 4—4 of FIG. 1.
Figure 4:
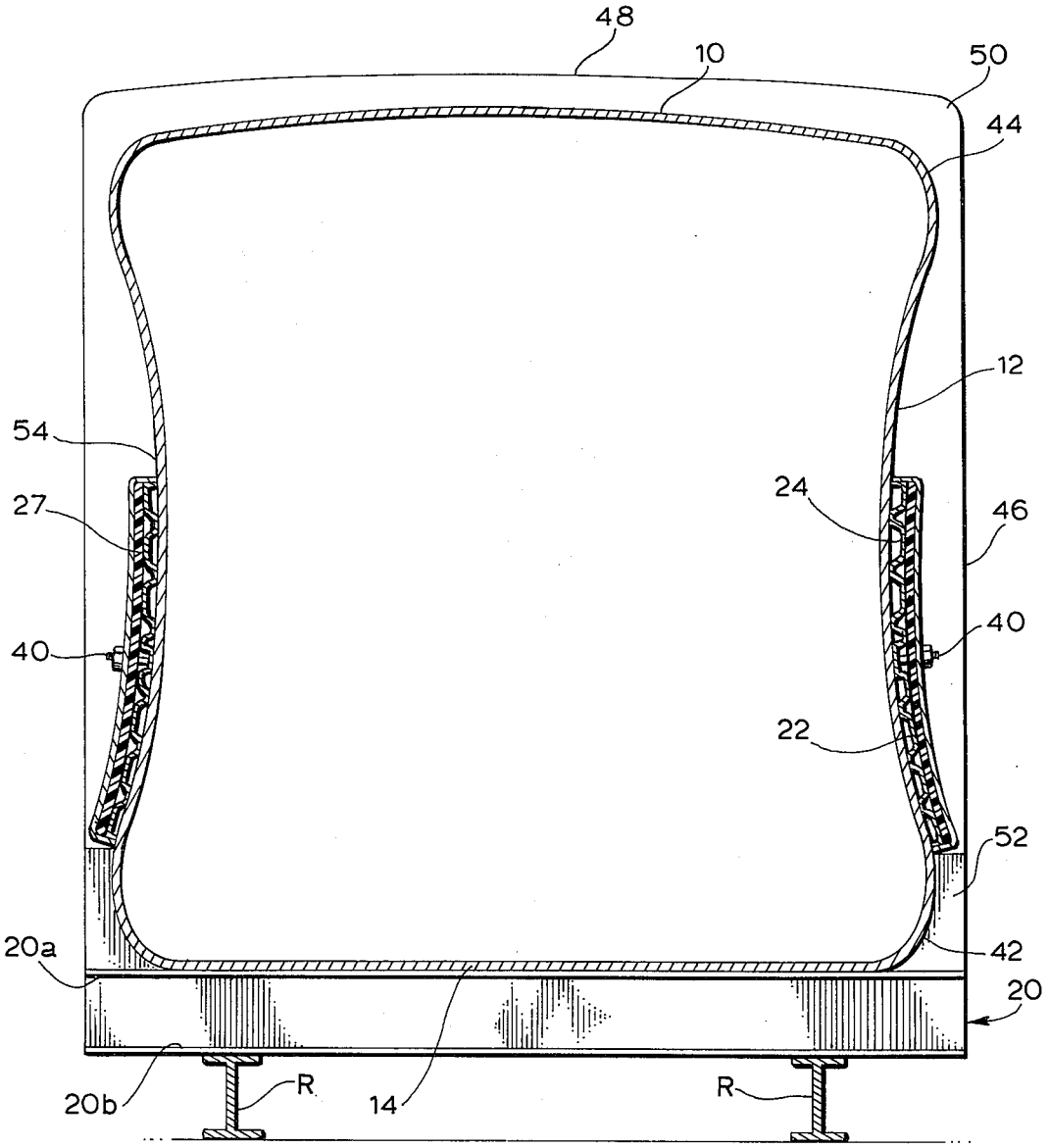

Referring now to FIGS. 1, 2, 3 and 4, a fermenting tank specifically designed for use in the brewing of beer will be seen to comprise a top wall 10, side walls 12 and a bottom 14. The top, side and bottom walls are all made of relatively thin sheets of stainless steel material, to ensure cleanliness of the interior of the tank, and to facilitate cleaning.

Front and back end walls 16 and 18 are formed of somewhat thicker stainless steel material shaped so as to match the top and side walls and the bottom, in a manner to be described below. The bottom 14 of the tank is supported on a plurality of transverse beams 20 which extend from side to side of the tank as shown. In practice, such beams 20 may themselves rest on two or more longitudinal rails, but would not in normal use be attached to such support rails. Such support rails are shown at R, and require no explanation. On either side of the side walls 12, lower and upper cooling jackets 22 and 24 are provided with inlet and outlet connections 25 and 26 at the front end of the tank and connected by any suitable return connection means (not shown) at the rear end of the tank, whereby the cooling liquid may be flowed from the lower jacket 22 and returned through the upper jacket 24.

A layer of insulating material such as expanded polystyrene insulating material or the like shown as 27 is placed over the cooling jackets 22 and 24. Around the exterior of the insulating layer 27, there are provided a plurality of exterior reinforcing plates. These plates comprise a central plate 28, and further plates 30, 32 and 34 arranged respectively in sequence towards each end of the tank. The plates are provided with interfitting tongue and notch portions 36 and 38, which simply interfit with one another, but are not interconnected in any way. The plates are supported on the tank by means of a series of studs 40 welded to the tank wall between the lower and upper cooling jackets 22 and 24.

In this way, the tendency for the tank walls to collapse inwardly or implode, when the tank is subjected to any reduced pressure is thereby resisted. At the same time, the plates 28, 30, 32, 34, do not provide any significant resistance to lengthwise expansion and contraction of the tank since the plates are not interconnected with one another, and in fact define a contraction space between each of the plates whereby if the tank should contract due to some unusually low temperature the plates will not impose any resistance, and will not stress the tank.

In order to assist in providing sufficient resistance to the hydrostatic pressures developed in the tank, the tank side walls 12 are bowed or curved inwardly along the length of the tank, and are provided with rounded corners 42, where they meet the flat bottom wall 14, and to provide greater strength.

The tank top wall 10 is formed in a shallow arch ie. an upward, or outward curvature so as to ensure that droplets of water or cleaning fluid will flow away from the top wall. If the top wall of the tank is made flat, then moisture will tend to cling to the surface, and it will be extremely difficult to clean it satisfactorily. Again, the junction or corners 44 between the side walls 12 and the top wall 10 are rounded or curved outwardly to provide greater strength.

In order to brace and reinforce the entire tank and to prevent the tank side walls 12 from bowing outwardly under the hydrostatic pressures developed when the tank is full, a series of side bracing or reinforcing ribs 46 are arranged at spaced intervals along each of the side walls 12, and a further series of upper bracing arches 48 are arranged at spaced intervals along the top wall 10 of the tank. The ribs 46 and arches 48 meet at the enlarged corner portions 50. The lower ends of the side ribs 46 are securely fastened to respective transverse beams 20, thereby completely encircling the tank.

In one form of the invention, the transverse beams 20 may in fact be composite structures formed of two channel shaped beams 20*a* and 20*b* fastened back to back to form a typical I section. The lower ends of the ribs 46 may simply be fitted between the two channels 20*a* and 20*b* and fastened by welding or bolting.

Further additional support for the curving corner 42 between the bottom wall 14 and the side wall 12 is provided in the form of additional reinforcing gusset plates 52 extending upwardly from the beams 20.

Referring once again to the side ribs 46 extending up the side walls 12, it will be noted that the ribs 46 are formed with an inner profile 54 which curves inwardly to match the concave inward curvature of the side walls 12. It is preferably notched at 56 so as to fit snugly around the exterior of the reinforcing plates 28–30–32–34. Thus the ribs 46 are at their widest in about the mid portion thereof, and are at their narrowest at either end.

The arches 48 are also given a curvature to precisely match the convex outward curvature of the top wall 10.

The ribs 46 and the arches 48 are made sufficiently wide throughout their length that straight lines drawn vertically through the ribs 46 and horizontally through the arches 48 will not intersect any portion of the side walls 12 or top wall 10, and such straight lines will intersect within the enlarged corner portions 50. In this way, the stresses developed in the side walls 12, tending to bow them outwardly will set up bending stresses in the ribs 46 which in turn will set up tensile stresses in the arches 48, thereby making the most efficient use of such ribs and arches.

It will thus be understood that while the arches 48 are of arcuate shape, they perform in fact as tie rods when subjected to such tensile stresses, due to the bending moments of the side ribs 46. This result is achieved by ensuring that a straight line drawn through the arch section does not intersect inside radius of the arch.

The ribs 46 and arches 48 are welded directly to the side walls 12 and top wall 10 and may therefore be subject to extention and contraction as and when the tanks is heated and cooled. Such expansion and contraction will tend to cause the ribs 46 and arches 48, and beams 20 to move slightly apart from one another, and unless such expansion and contraction is permitted to take place relatively freely severe stresses will be built up which may damage the tank.

Accordingly, where the ribs 46 overlie the mid portions of the plates 28, 30, 32 and 34 they may be welded to the exterior of such plates. However, where the alternate ribs 46 overlie the tongues 36, the ribs should not be welded at all to either of the adjoining plates. By leaving this area of the ribs 46 free of any welding or fastening to the plates 28, 30, 32 and 24, a sliding action can take place which will permit such expansion and contraction without damage.

Also, since the beams 20 are not tied to the rails R, the beams 20 may slide therealong to accommodate such movement.

In order to provide certain additional support at the ends of the tank, additional horizontal reinforcing ribs 58 may be provided which extend right around the front and back ends 14 and 16, and are welded directly to the end most adjoining ribs 46 as shown.

In this way, by providing the inwardly bowed side walls, and upwardly arched top wall, and the ribs and arches providing the full tensile stress of the metal available for resistance to the hydrostatic tank pressures, an extremely rugged and reliable tank is provided which may be manufactured relatively economically of thin, relatively light gauge sheet stainless steel material, up to very substantial tank capacities. In addition, provision is made for expansion and contraction in a most advantageous manner without setting up undue stresses in the tank as a result.

The various factors inherent the tank of the present invention interact with one another in an unusually favourable manner, to produce various unique advantages. For example, it is clear that the greatest hydrostatic pressures will be produced in the region of the lower corners 42. However, it will be also be appreciated that the use of a shorter radius of curvature in this region will produce greater strength, than the longer radius of curvature for example in the side walls 12 themselves. Thus the relatively thin sheet metal, in the region of the corners 42, is inherently stronger. In addition, however the use of the gusset plates 52 which, in the case of the embodiment as shown in FIG. 1, are located at more frequent intervals than the actual ribs 46, provides added strength in an economical yet highly efficient manner.

Such gusset plates also provide added reinforcement for the side ribs 46, which are at their thinnest, where they extend around the corners 42.

In addition, the shaping of the side ribs 46, provides the maximum width at the centre point, which requires the greatest strength, since it is furthest from each of the ends of the side ribs 46.

Since the side walls 12 of the tank are completely supported by the ribs 46, they cannot bow outwardly, and accordingly there are no stresses imposed on the top wall 10 of the tank which would otherwise tend to cause it to bow inwardly. The outward bowing of the side walls of the tank is substantially completely prevented by the tie rod effect of the horizontal arches 48.

Additional support for the lower portions of the side walls 12, where the hydrostatic pressures are at their greatest, is provided through the means of the reinforcing plates 28–30–32–34, and the dimple sheet jackets 22 and 24.

It will be appreciated that the shaping of the top wall 10 is mainly dependant on the design requirements of the end user. The brewery and distillery trade require an upwardly curved top wall to facillitate cleaning of the tank interior. However, it is possible that other users would not have this requirement in which case the wall curvature could be varied, or it could even be flat, the principal requirement being that the horizontal, or top braces or rib should be stressed in tension and function as tie rods.

For this purpose the width of the top braces, where the top is curved, must be sufficient to permit straight lines extending along the side braces and top brace to intersect one another within the fabric of the upper corners, and without intersecting their respective side and top walls.

It will further be appreciated that the provision of the cooling jackets is optional, depending upon the end use. The jackets may also be heating jackets, or they may be unnecessary, in which case the reinforcing plates are also unnecessary.

Different forms of tank access means may be provided, the details being irrelevant for the purpose of the invention.

The foregoing is a description of a preferred embodiment of the invention which is given here by way of example only. The invention is not to be taken as limited to any of the specific features as described but comprehends all such variations as come within the scope of the appended claims.

What is claimed is:

1. A tank for flowable material such as fluids, liquid, semi-liquid materials and the like creating substantial hydro-static pressures therein, said tank comprising;

a bottom wall, opposite side walls extending upwardly therefrom and a top wall and two end walls defining an elongated enclosed chamber;

means supporting said bottom wall at spaced intervals and extending from side to side thereof;

side support braces extending upwardly along the exterior of said side walls and having upper and lower ends;

top support braces extending across the exterior of said top wall from side to side thereof;

lower corners joining the lower ends of said side support braces with at least some of said bottom wall supporting means;

upper corners joining the upper ends of said side support braces with respective ends of said top support braces;

said side walls being characterized by a shape which is inwardly curved along the length of said tank, and said side support braces being shaped to follow the inwardly curved shape thereof, and wherein a straight line passing through a said side support brace and a straight line passing through its respective top support brace intersect one another at right angles at a point lying within the respective said upper corner joining said side brace and top brace, and wherein no such straight lines intersect said side walls or said top wall of said tank.

2. A tank as claimed in claim 1 wherein said top wall has a shape which is outwardly curved along the length of said tank, and wherein the junctions between the respective side walls and top wall are formed in an outwardly curved shape along the length of the tank.

3. A tank as claimed in claim 2 wherein the top support braces are shaped to conform to the outwardly curved shape of said top wall.

4. A tank as claimed in claim 3 including corner support braces extending aroung the outwardly curved shape of the junction between the bottom wall and the two side walls, intermediate the side support braces.

5. A tank as claimed in claim 4 including additional said corner support braces attached to said side support braces.

6. A tank as claimed in claim 3 wherein said upper corners joining a said top brace and its respective side braces extend outwardly from said tank sufficient distance to permit the intersection of said straight lines within said corners.

7. A tank as claimed in claim 1 wherein the side braces have inner and outer edges, the inner edges being curved, to follow the inwardly curved shape of the side walls, and the outer edges of said side braces being straight.

8. A tank as claimed in claim 1 including end wall brace means for strengthening the same, and access opening means in at least one said end wall.

9. A storage tank as claimed in claim 1 including heat exchanger jacket means extending along each side wall, and reinforcing plate means around said jacket means, said plate means being discontinuous to allow for expansion and contraction of said tank.

10. A storage tank as claimed in claim 9 wherein the reinforcing plate means incorporate adjacent overlapping interfitting sections, free of connection with one another, and supported from the exterior by at least some of said side support braces.

11. A tank as claimed in claim 1 including reinforcing plate means attached to the exterior of said side walls extending along the lower portions thereof, said plate means being discontinuous to allow for lengthwise expansion and contraction of said tank, and being inwardly curved to follow the contour of said side walls.

12. A tank as claimed in claim 11 wherein said reinforcing plate means incorporate adjacent overlapping interfitting sections, free of connection with one another, and supported from the exterior by at least some of said support braces.

* * * * *